US010240753B2

(12) United States Patent
Jorgensen

(10) Patent No.: US 10,240,753 B2
(45) Date of Patent: Mar. 26, 2019

(54) LED INSERT HAVING A LIGHT HOUSE RING AND A LENS HOUSE RING THAT IS MOVABLE WITH RESPECT TO THE LIGHT HOUSE RING

(71) Applicant: Angela Jorgensen, Chicago, IL (US)

(72) Inventor: Angela Jorgensen, Chicago, IL (US)

( * ) Notice: Subject to any disclaimer, the term of this patent is extended or adjusted under 35 U.S.C. 154(b) by 0 days.

(21) Appl. No.: 15/465,109

(22) Filed: Mar. 21, 2017

(65) Prior Publication Data

US 2017/0268748 A1 Sep. 21, 2017

Related U.S. Application Data

(60) Provisional application No. 62/311,021, filed on Mar. 21, 2016.

(51) Int. Cl.

| | |
|---|---|
| ***F21V 14/06*** | (2006.01) |
| ***F21V 5/04*** | (2006.01) |
| ***F21V 7/06*** | (2006.01) |
| ***F21V 17/02*** | (2006.01) |
| ***H05B 33/08*** | (2006.01) |
| ***H05B 37/02*** | (2006.01) |
| *F21Y 115/10* | (2016.01) |
| *F21Y 113/13* | (2016.01) |

(52) U.S. Cl.

CPC ..... *F21V 14/06* (2013.01); *F21V 5/04* (2013.01); *F21V 7/06* (2013.01); *F21V 17/02* (2013.01); *H05B 33/0803* (2013.01); *H05B 37/02* (2013.01); *F21Y 2113/13* (2016.08); *F21Y 2115/10* (2016.08)

(58) Field of Classification Search

CPC ..... F21Y 2115/10; F21V 4/00; F21V 14/003; F21V 14/006; F21V 14/02; F21V 14/025; F21V 14/04; F21V 14/045; F21V 14/06; F21V 14/065; F21V 14/08; F21V 14/085

See application file for complete search history.

(56) References Cited

U.S. PATENT DOCUMENTS

| | | | | |
|---|---|---|---|---|
| 6,367,949 | B1 | 4/2002 | Pederson | |
| 7,144,135 | B2 | 12/2006 | Martin et al. | |
| 7,507,001 | B2 | 3/2009 | Kit | |
| 7,784,969 | B2 | 8/2010 | Reisenauer et al. | |
| 8,456,107 | B2 * | 6/2013 | Salm | F21V 7/00 315/185 R |

(Continued)

*Primary Examiner* — Robert J May

(74) *Attorney, Agent, or Firm* — Global Intellectual Property Agency, LLC; Daniel Boudwin

(57) ABSTRACT

An LED insert for a parabolic aluminized reflector light. The LED insert includes a light housing including a first ring. A plurality of support rods extending perpendicular from a front side of the light housing. A lens housing includes a second ring having a plurality of apertures disposed thereon, wherein each aperture receives one of the plurality of support rods therethrough. The LED insert further includes a motor operably connected to a control circuit, a first gear operably connected to the motor via a drive belt, and a second gear engaging the first gear, the second gear oriented perpendicular to the first gear. A threaded rod extends from the second gear through a threaded aperture on the lens housing. The lens housing is configured to translate along the length of the threaded rod upon actuation of the motor.

10 Claims, 2 Drawing Sheets

(56) References Cited

U.S. PATENT DOCUMENTS

| | | | | |
|---|---|---|---|---|
| 8,870,416 | B2 * | 10/2014 | Liu | H01L 33/58 257/E33.073 |
| 9,829,174 | B2 * | 11/2017 | Schouboe | F21V 5/007 |
| 9,958,140 | B2 * | 5/2018 | Friedland | F21V 14/06 |
| 2006/0221606 | A1 | 10/2006 | Dowling | |
| 2010/0060194 | A1 | 3/2010 | Furry et al. | |
| 2013/0141908 | A1 | 6/2013 | Rodriguez et al. | |
| 2016/0061439 | A1 * | 3/2016 | Jurik | A63J 5/025 362/96 |

* cited by examiner

LED INSERT HAVING A LIGHT HOUSE RING AND A LENS HOUSE RING THAT IS MOVABLE WITH RESPECT TO THE LIGHT HOUSE RING

CROSS REFERENCE TO RELATED APPLICATIONS

This application claims the benefit of U.S. Provisional Application No. 62/311,021 filed on Mar. 21, 2016. The above identified patent application is herein incorporated by reference in its entirety to provide continuity of disclosure.

FIELD OF THE INVENTION

The present invention relates to LED inserts. More specifically, the present invention provides an LED insert that can be installed within a parabolic aluminized reflector light.

BACKGROUND OF THE INVENTION

Parabolic aluminized reflector lights (hereafter "PARCANs") are widely used in commercial, residential, and other types of illumination. PARCANs are particularly widespread in live theater production, where they are often used to apply different lighting effects to a stage. PARCANs typically emit white light, which can be made into a colored light by attaching a gel filter screen to the front of the PARCAN. However, this method of adding a color to the PARCAN can be time consuming, and only allows for the PARCAN to produce one additional color. Additionally, the properties of the colored light such as its zoom and focus cannot always be adjusted if a gel filter is used. There exist some PARCANs that utilize LEDs to produce different colors, however these units are often very expensive and cannot be used to provide the white light of the traditional PARCAN. It is therefore desirable to provide an LED insert for a PARCAN such that the PARCAN can emit different colors of lights, wherein the colored light can be zoomed in or focused according to user preference.

In light of the devices disclosed in the prior art, it is submitted that the present invention substantially diverges in design elements from the prior art and consequently it is clear that there is a need in the art for an improvement to existing LED inserts. In this regard the instant invention substantially fulfills these needs.

SUMMARY OF THE INVENTION

In view of the foregoing disadvantages inherent in the known types of LED inserts now present in the prior art, the present invention provides an LED insert wherein the same can be utilized for providing convenience for the user when converting a PAR-CAN to LED operation. The LED insert includes a light housing including a first ring. A plurality of support rods are disposed on a front side of the light housing extending perpendicularly therefrom. A lens housing includes a second ring having a plurality of apertures disposed thereon, wherein each aperture receives one of the plurality of support rods therethrough. The LED insert further includes a control circuit, a motor operably connected to the control circuit, a first gear operably connected to the motor via a drive belt, and a second gear engaging the first gear, the second gear oriented perpendicular to the first gear. A threaded rod extends from the second gear through a threaded aperture on the lens housing. The lens housing is configured to translate along the length of the threaded rod upon actuation of the motor. The movement of the lens housing allows a lens to focus and zoom the LED lights supported within the light housing. The control circuit allows a user to control the color and sequence of the lights, as well as the position of the lens.

Other objects, features and advantages of the present invention will become apparent from the following detailed description taken in conjunction with the accompanying drawings

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
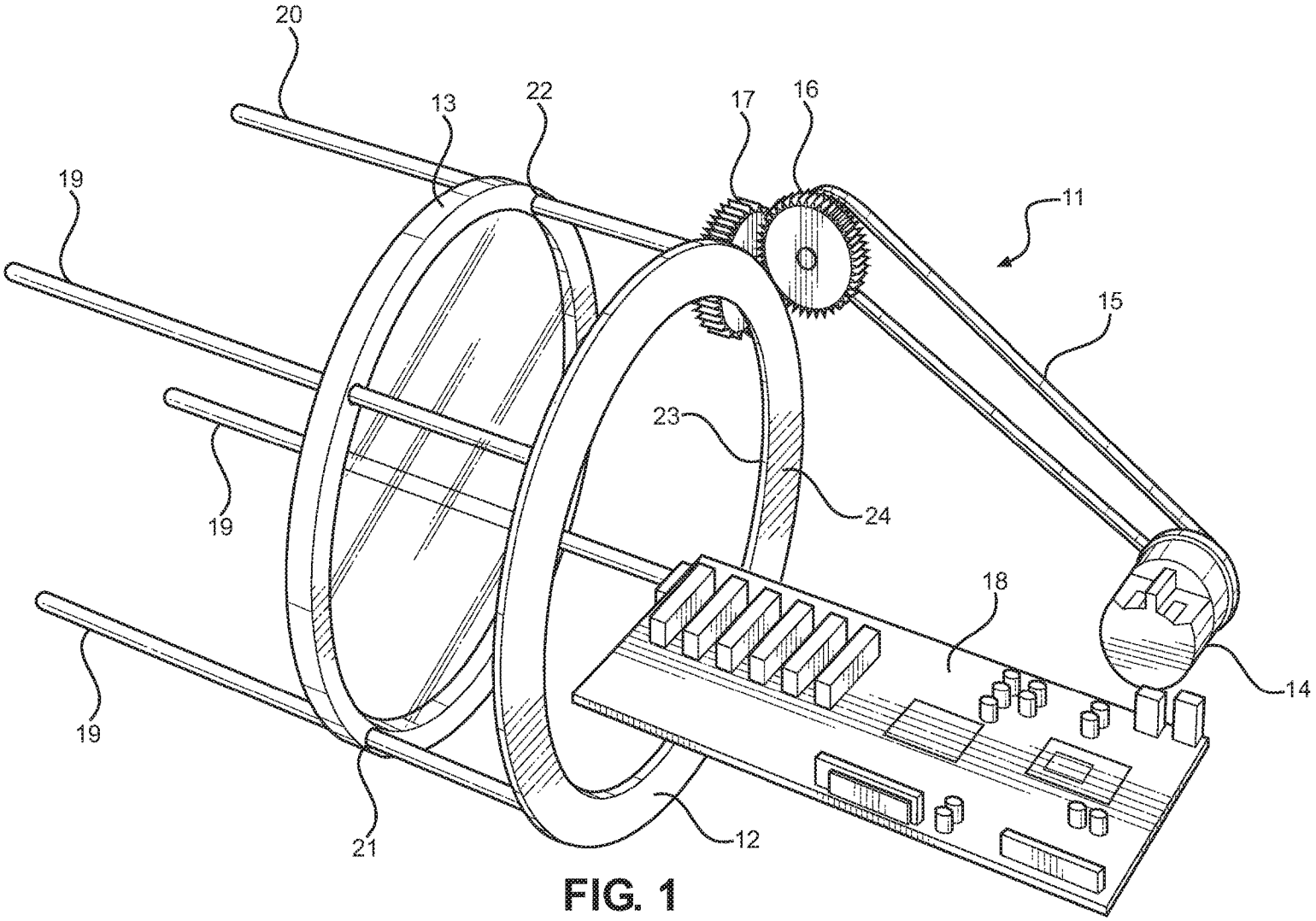
FIG. 1 shows a perspective view of the LED insert.

Reference is made herein to the attached drawings. Like reference numerals are used throughout the drawings to depict like or similar elements of the LED insert for use with a PARCAN. For the purposes of presenting a brief and clear description of the present invention, the preferred embodiment will be discussed as used for converting a PARCAN to emit different colors of lights via different LEDs. The figures are intended for representative purposes only and should not be considered to be limiting in any respect.

Referring now to FIG. 1, there is shown a perspective view of an LED insert according to the present invention. The LED insert 11 generally includes a light housing 12 having a ring shape, wherein the lighting housing is adapted to receive an LED light insert. A plurality of support rods 19 are disposed on a front side 23 of the light housing 12. The LED insert 11 further includes a lens housing 13, which also has a ring shape. The lens housing 13 includes a plurality of apertures 21 thereon. Each support rod 19 is inserted through one of the apertures 21 of the lens housing 13 in order to provide structural support. The apertures 21 and support rod 19 are smooth, such that the lens housing 13 can slide freely along the plurality of support rods 19.

The LED insert 11 further includes a control circuit 18 that controls operation thereof. The control circuit 18 can include a wireless transceiver, which allows the control circuit 18 to be operated via a remote controller. Alternatively, the control circuit 18 can include a wired connection to a control panel.

A motor 14 is operably connected to the control panel 18. The motor 14 can be an electric motor or any other conventional motor that provides a rotational output motion. The motor 14 is operably connected to a first gear 16 via a drive belt 15, such that rotation of the motor 14 causes rotation of the first gear 16 in the same direction. The first gear 16 engages a second gear 17 which is operably connected thereto. In the illustrated embodiment, the second gear 17 is oriented perpendicular to the first gear 16 in order to convert the motion of the first gear 16 to rotational motion in a perpendicular plane. However, other gear systems and orientations may be utilized to accomplish the same change in rotational direction.

A threaded rod 20 extends from the second gear 17 toward the lens housing 13, such that rotation of the second gear 17 causes rotation of the threaded rod 20. The threaded rod 20 is inserted through a corresponding threaded opening 22 disposed on the lens housing 13. Rotation of the threaded rod 20 causes the lens housing 13 to move due to its engagement with the threaded opening 22 thereon. The lens housing 13 translates along the plurality of support rods 19, since the smooth apertures 21 allow the lens housing 13 to slide along the length of the smooth support rods 19. In the illustrated embodiment, three support rods 19 are utilized, and are positioned such that the support rods 19 and threaded rod 20 are equidistant from one another. However, in alternate embodiments, the number of support rods may be greater or less than three.

Figure 2:
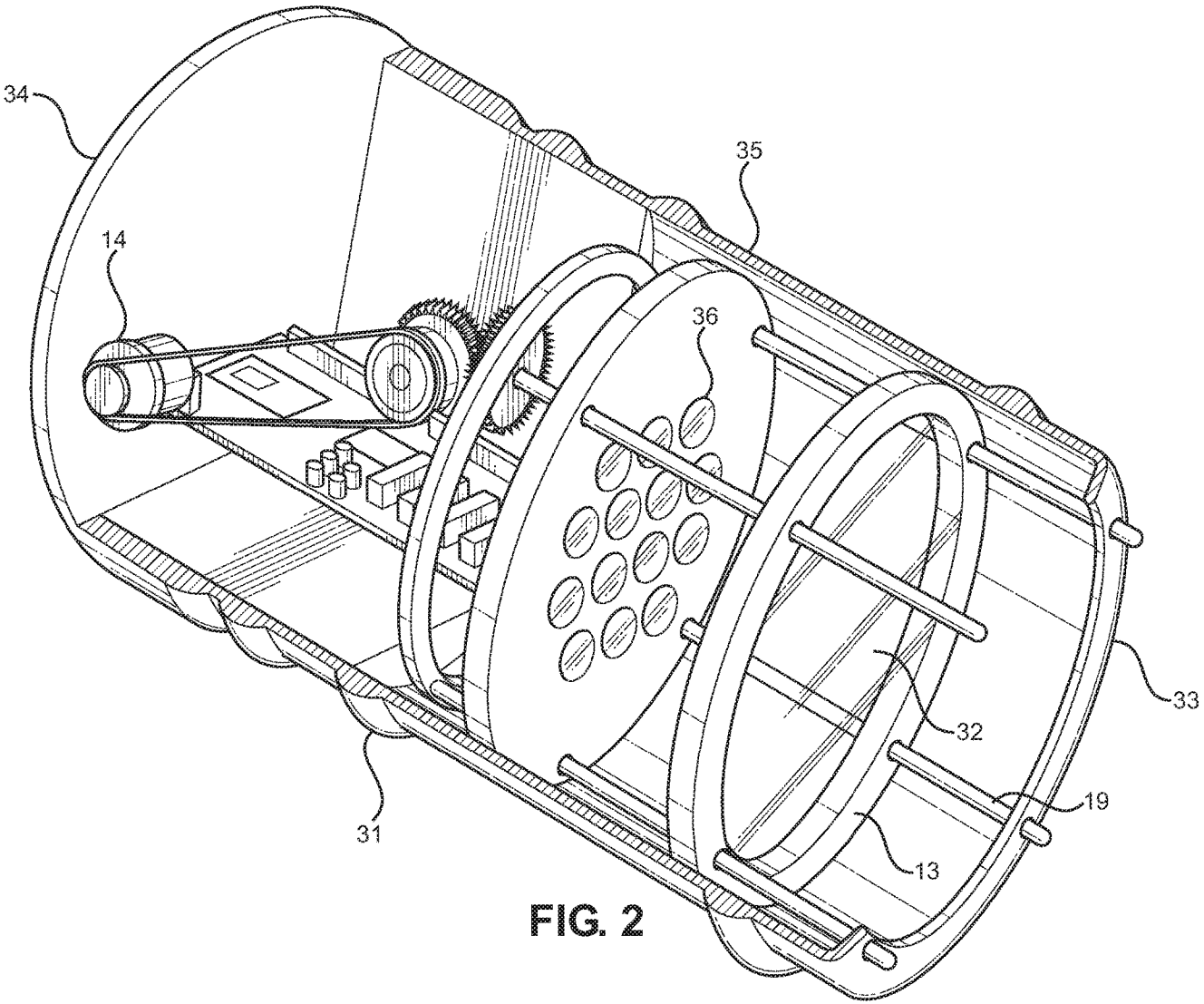
FIG. 2 shows a cross-sectional perspective view of the LED insert installed within a PARCAN.

Referring now to FIG. 2, there is shown a cross-sectional perspective view of the LED insert installed within a PARCAN. The LED insert is sized to be installed within a PARCAN housing 31, when installed, the motor 14 is disposed toward a rear end 34 of the PARCAN housing 31, and the lens housing 13 is disposed toward the open front end 33 of the PARCAN housing 31.

When the LED insert is fully installed within the PARCAN housing 31, an LED assembly 35 is secured to the light housing 12, and a lens 32 is secured within the lens housing 32. The lens 32 is configured to control the focal length of the light admitted by the LED assembly 35. The LED assembly 35 is operably connected to the control circuit 18, which is configured to control operation of the individual LEDs 36. The individual LEDs 36 can vary in size and color. Upon actuation of the motor 14, the lens 32 moves further away from or closer to the LED assembly 36, increasing or decreasing the focal length of the light emitted from the LED assembly 35. In this way, the zoom and focal length of the emitted light can be controlled by the operator.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An LED insert, comprising:

a light housing comprising a first ring configured to receive a light;

a plurality of support rods disposed on the light housing, each rod extending perpendicularly from a front side thereof;

a lens housing comprising a second ring configured to receive a lens, the lens housing positioned adjacent to the front side of the light housing;

a plurality of apertures disposed on the lens housing, each aperture configured for sliding engagement with one of the plurality of support rods;

a motor operably connected to the lens ring, the motor configured to alter a distance between the light housing and the lens housing;

a first gear operably connected to the motor via a drive belt;

a second gear engaging the first gear;

a threaded rod extending from the second gear through a threaded aperture of the plurality of apertures on the lens housing;

wherein the lens housing is configured to translate along the plurality of support rods upon rotation of a threaded rod via actuation of the motor.

2. The LED insert of claim 1, wherein the first gear is oriented perpendicular to the second gear.

3. The LED insert of claim 1, wherein a control circuit controls actuation of the motor.

4. The LED insert of claim 3, wherein the control circuit is operably connected to a power supply.

5. The LED insert of claim 3, further comprising an LED assembly supported by the light housing.

6. The LED insert of claim 5, wherein the LED assembly comprises one or more LEDs operably connected to the control circuit.

7. The LED insert of claim 3, wherein the control circuit further comprises a wireless transceiver configured to communicate with a wireless controller.

8. The LED insert of claim 1, further comprising a focus lens supported by the lens housing.

9. The LED insert of claim 1, wherein the plurality of support rods includes three support rods.

10. The LED insert of claim 1, wherein the support rods and the threaded rod are disposed equidistant from each another.

* * * * *